US009611129B2

(12) United States Patent
Huber et al.

(10) Patent No.: US 9,611,129 B2
(45) Date of Patent: Apr. 4, 2017

(54) LIFT CYLINDER COMPRISING A DEFLECTION ROLLER DEVICE FOR AN INDUSTRIAL TRUCK

(71) Applicant: Jungheinrich Aktiengesellschaft, Hamburg (DE)

(72) Inventors: Christian Huber, Wartenberg (DE); Laurentius Siebold, Haag (DE)

(73) Assignee: JUNGHEINRICH AKTIENGESELLSCHAFT, Hamburg (DE)

( * ) Notice: Subject to any disclaimer, the term of this patent is extended or adjusted under 35 U.S.C. 154(b) by 0 days.

(21) Appl. No.: 14/762,848

(22) PCT Filed: Jan. 22, 2014

(86) PCT No.: PCT/EP2014/051216
§ 371 (c)(1),
(2) Date: Jul. 23, 2015

(87) PCT Pub. No.: WO2014/118050
PCT Pub. Date: Aug. 7, 2014

(65) Prior Publication Data

US 2015/0360922 A1 Dec. 17, 2015

(30) Foreign Application Priority Data

Jan. 31, 2013 (DE) ..... 10 2013 201 655

(51) Int. Cl.
*B66F 9/22* (2006.01)
*B66F 9/08* (2006.01)
*B66F 9/07* (2006.01)

(52) U.S. Cl.
CPC ..... *B66F 9/22* (2013.01); *B66F 9/07* (2013.01); *B66F 9/08* (2013.01)

(58) Field of Classification Search
CPC ..... B66F 9/22; B66F 9/07; B66F 9/08
(Continued)

(56) References Cited

U.S. PATENT DOCUMENTS 2,979,162 A * 4/1961 Quayle ..... B66F 9/08 187/226
3,433,325 A * 3/1969 McIntosh ..... B66F 9/08 187/222

(Continued)

FOREIGN PATENT DOCUMENTS

DE 23 35 287 A1 2/1974
DE 29 622 553 U1 4/1997

(Continued)

OTHER PUBLICATIONS

International Search Report cited in PCT/EP2014/051216 dated Apr. 3, 2014, 4 pgs.

(Continued)

*Primary Examiner* — Michael Riegelman
(74) *Attorney, Agent, or Firm* — Rothwell, Figg, Ernst & Manbeck, PC

(57) ABSTRACT

A lift cylinder comprises a deflection roller device for an industrial truck. The deflection roller device includes a roller support, a lifting chain deflection roller having a roller axle and a roller body rotatably carried on the roller axle, and a first additional deflection roller arranged axially adjacent to the lifting chain deflection roller. The roller axle includes a cylindrical bearing portion and fastening ends projecting axially outwards on either side of the cylindrical bearing portion and fastened to the roller support. The first additional deflection roller is supported on a first additional-deflection roller support such that the axis of rotation of the first additional deflection roller is offset relative to the axis of rotation of the lifting chain deflection roller, and the axis of (Continued)

rotation of the first additional deflection roller extends through the roller body of the lifting chain deflection roller.

9 Claims, 2 Drawing Sheets

(58) Field of Classification Search
USPC ..... 187/229
See application file for complete search history.

(56) References Cited

U.S. PATENT DOCUMENTS

| | | | | | |
|---|---|---|---|---|---|
| 3,894,616 | A * | 7/1975 | Kawanishi | B66F 9/08 | 187/228 |
| 3,968,859 | A | 7/1976 | Ehrhardt | | |
| 3,987,870 | A * | 10/1976 | Wojtyna | B66F 9/205 | 187/228 |
| 4,585,093 | A * | 4/1986 | Barda, Jr. | B66F 9/08 | 187/227 |
| 4,600,084 | A * | 7/1986 | Ray | B66F 9/08 | 137/561 A |
| 4,721,187 | A * | 1/1988 | Riddle | B66F 9/08 | 187/227 |
| 4,896,748 | A * | 1/1990 | Mikkelsen | B66F 9/205 | 187/226 |
| 5,992,571 | A * | 11/1999 | Lee | B66F 9/205 | 187/228 |
| 6,505,710 | B1 * | 1/2003 | Kato | B66F 9/08 | 187/226 |
| 7,410,435 | B2 * | 8/2008 | Yoshikawa | B66F 9/205 | 187/228 |
| 2005/0034928 | A1 * | 2/2005 | Lewis | B66F 9/08 | 187/230 |
| 2007/0012520 | A1 | 1/2007 | Hayashi | | |
| 2010/0065377 | A1 * | 3/2010 | Billger | B66F 9/08 | 187/226 |
| 2015/0158707 | A1 * | 6/2015 | Brotherton | B66F 9/08 | 187/238 |

FOREIGN PATENT DOCUMENTS

| | | | | |
|---|---|---|---|---|
| DE | 10 2004 037 339 | A1 | | 3/2005 |
| EP | 1 505 033 | A1 | | 2/2005 |
| EP | 1 743 865 | A1 | | 1/2007 |
| JP | 05319792 | A | * | 12/1993 |
| JP | 07157295 | A | * | 6/1995 |
| JP | H10 338 487 | A | | 12/1998 |
| WO | 2010 030797 | A1 | | 3/2010 |

OTHER PUBLICATIONS

Search Report received in the German basic application No. 10 2013 201 655.7 dated Jan. 16, 2014, 4 pgs.

* cited by examiner

-Prior Art-

LIFT CYLINDER COMPRISING A DEFLECTION ROLLER DEVICE FOR AN INDUSTRIAL TRUCK

CROSS REFERENCE TO RELATED APPLICATION

This application is a 35 U.S.C. 371 National Phase Entry Application from PCT/EP2014/051216, filed Jan. 22, 2014, which claims the benefit of German Patent Application No. 10 2013 201 655.7 filed on Jan. 31, 2013, the disclosures of which are incorporated herein in their entirety by reference.

The invention relates to a lift cylinder comprising a deflection roller device for an industrial truck, the deflection roller device having a lifting chain deflection roller having a roller axle and a roller body which is rotatable on the roller axle, a roller support and at least one additional deflection roller which is arranged laterally next to the lifting chain deflection roller, the roller axle having a preferably cylindrical bearing portion which is received in the roller body, and fastening ends which project axially outwards on either side thereof, which ends are fastened to the roller support.

Such lift cylinders are used in lifting frames of industrial trucks as hydraulic lifting drives for vertically moving loads and load-carrying devices, such as the load-carrying fork arms on fork-lift trucks. Depending on the type of lifting frame, one or more lift cylinders may be provided. In the simplest case, the lifting frame comprises merely a fixed pair of masts on which the load-carrying device, for example a lifting carriage having load-carrying fork arms, is guided so as to be vertically movable. An upright lift cylinder is located in a view-through region between the lifting-frame masts, the piston rod thereof being extensible upwards in order to raise the load-carrying device and any load lying thereon. This takes place by means of a translation of movement by a lifting chain. The lifting chain is fastened at one of its ends to the cylinder casing of the lift cylinder or possibly to the relevant pair of lifting-frame masts, and is guided about a deflection roller on the upper piston-rod end of the lift cylinder, which end is entrained thereby according to the movements of the piston rod. The other end of the lifting chain is fastened to the vertically movable load-carrying device. If the lift cylinder is then activated in order to extend the piston rod thereof upwards out of the most greatly retracted position, the load-receiving means move faster than the extending piston rod due to the translation by means of the deflected lifting chain. The load-receiving means can be lowered again correspondingly quickly by retracting the piston rod.

In the case of telescopic lifting frames, for example double lifting frames or triple lifting frames, in addition to a fixed outer pair of masts, one or possibly a plurality of telescopable inner pair(s) of masts is/are provided, with which individual lift cylinder-lifting chain systems may be associated. Such telescopic lifting frames usually permit a free lift of the load-carrying device without the telescopable inner pairs of masts being extended. The lift cylinder for the free lift is connected to the load-carrying device in the manner described above via a lifting chain which is deflected on a deflection roller at its piston-rod end. Such a lift cylinder is usually arranged between the lifting-frame masts in a view-through region for the operator of the industrial truck, and forms there an interfering contour which obstructs the view in part. Should such a lift cylinder have merely one deflection roller for the lifting chain on its upper piston-rod end, there is the possibility of designing said cylinder so as to be relatively slim over virtually the entire length, so that it obstructs the view only comparatively little in the view-through region of the lifting frame.

The load-carrying devices which are to be raised or lowered, together with their load-receiving means, are in many cases equipped with additional functions, for instance the possibility of moving fork arms laterally in order to adjust them jointly or to change the distance thereof relative to each other. The drives necessary for this, whether hydraulic drives or pneumatic drives or electrical drives, require supply lines which have to follow the lifting movements of the load-carrying device. In most cases, these supply lines are hydraulic hoses which are guided about their own additional deflection rollers on the piston-rod end of the lift cylinder so as to be able to follow the lifting movements of the load-carrying devices in a space-saving and guided manner. In the lift cylinders known hitherto of the type considered here having additional deflection rollers for hydraulic hoses arranged laterally next to the lifting chain deflection roller, the deflection rollers for the lifting chain and for the hydraulic hoses are located axially next to one another on a common axis of rotation of a deflection roller device on the upper piston-rod end of the lift cylinder. The lift cylinder is thus widened by the deflection roller device at the upper piston-rod end thereof and thus obstructs the view in the view-through region between the lifting-frame masts.

It is an object of the present invention to make a lift cylinder of the type mentioned at the outset, having a plurality of deflection rollers, slimmer than hitherto, so that when arranged as intended on the lifting frame of an industrial truck said cylinder obstructs the view in the view-through region of the lifting frame as little as possible.

This object is achieved according to the invention in that the additional deflection roller is arranged on an additional-deflection roller support such that the physical axis of rotation of said deflection roller is offset relative to the physical axis of rotation of the lifting chain deflection roller, and the additional deflection roller overlaps in the radial direction at least in portions with one of the fastening ends of the roller axle of the lifting chain deflection roller. This allows the additional deflection roller to be brought close to the lifting chain deflection roller in an axially parallel direction, largely bridging the space necessary for mounting the deflection roller axle on the roller support. It is true that the solution proposed here requires, in some embodiments, an increase in the height of the deflection roller device on the piston-rod end of the lift cylinder, since the physical axis of rotation of the additional deflection roller extends vertically upwards offset relative to the physical axis of rotation of the lifting chain deflection roller. However, the additional deflection roller may move laterally closer to the roller body of the lifting chain deflection roller, the result of which is to permit the operator to in practice have a more favourable view through the view-through region than was the case with the previous broader designs according to the prior art.

According to a further optimisation measure of the present invention, provision is made for the fastening ends of the roller axle of the lifting chain deflection roller, forming a respective step having an overlying recess, in a lower—when the lift cylinder is upright—cross-sectional region of the cylindrical bearing portion, to project axially from said portion, and for the additional deflection roller to be arranged in one of the recesses at least in part. Such a solution can be implemented for example in that a cylindrical axle pin is used as a roller axle, which axle pin is stepped at the axial ends thereof so as to have axially outer steps of for example semicircular cross-section which form the fastening ends of the roller axle. These steps produce a respective clearance which can be used to arrange the additional deflection roller somewhat deeper. This means that the deflection roller device as a whole is made even more compact and presents an even smaller viewing obstruction.

The roller support is preferably designed as a U-shaped yoke having a base and two U-arms which project upwards therefrom. Said roller support is fastened by its base to the upper extensible end of the lift cylinder, the lifting chain deflection roller being rotatably fastened to the U-arms by the fastening ends of its roller axle, and being received in regions between the U-arms. In this manner, the lifting chain deflection roller can be attached to the lift cylinder by simple means and in a very space-saving manner, preferably by means of a screw connection between the roller support and the end of the lift cylinder which is on the piston-rod side. According to a preferred embodiment, the roller axle lies with its fastening ends on the projecting U-arms of the roller support, and is screwed thereto there. For this purpose, the U-arms may be shaped on their upper sides in a manner complementary to the faces of the fastening ends of the roller axle which lie thereon, i.e. so as to be approximately semicircular when seen in a side view, if the fastening ends of the roller axle are designed as projections which are semicircular in cross-section. The fixing between the roller axle and the roller support preferably takes place by screwing the fastening ends to the U-arms of the roller support.

The additional-deflection roller support, according to a development of the invention, is fastened to the roller support and extends upwards with one end externally along a U-arm of the roller support beyond said roller support (when the lift cylinder is upright), holding at this one end a axle (or possibly shaft) of the additional deflection roller. A very simple structure of the deflection roller device can be achieved in that the additional-deflection roller support is a plate element which is screwed laterally externally to the relevant U-arm of the roller support and has on the end thereof which projects upwards a bearing for the axle (or possibly shaft) of the additional deflection roller. Preferably the additional deflection roller is rotatably held on a axle which is mounted in fixed manner on the additional-deflection roller support. In an alternative embodiment, a shaft which is mounted so as to rotate might also be connected in a rotationally-engaged manner to the additional deflection roller. The axle (or possibly shaft) of the additional deflection roller, according to a particularly preferred embodiment of the invention, is axially mounted on one side on the additional-deflection roller support, so that the axial side of the additional deflection roller opposite the mounting can be positioned very close to the roller body of the lifting chain deflection roller, because the additional deflection roller does not need any space for its own mounting there. This likewise contributes to a slimmer structural form of the deflection roller device and hence of the lift cylinder.

According to a further embodiment of the invention, the additional-deflection roller support bears a protective hood which externally covers the additional deflection roller, and which may also extend over the lifting chain deflection roller.

According to a further embodiment of the invention, provision is made for the deflection roller device to have a further additional deflection roller, the additional deflection rollers being provided on additional-deflection roller supports in an at least approximately symmetrical arrangement relative to the lifting chain deflection roller on either side of the lifting chain deflection roller. In this manner, a plurality of supply lines may be guided to the load-carrying device in a space-saving and reliable manner. If, however, only one additional deflection roller is required, the other one can be removed easily by unscrewing the additional-deflection roller support thereof from the U-shaped roller support.

The present invention also relates to a lifting frame having lifting-frame masts and a load-carrying device which can be raised and lowered thereon, a lift cylinder according to any of claims 1-7 and having a lifting chain for the load-carrying device which cooperates with the lift cylinder, the lift cylinder being arranged in a view-through region of the lifting frame between lifting-frame masts. The lifting frame which is thus configured is thus prepared to guide supply lines to the load-carrying device by means of deflection on the additional deflection roller if required, so that these supply lines can follow lifting and lowering movements of the load-carrying device in an ordered manner.

Preferably, the lifting frame is a telescopic lifting frame, for example a double lifting frame or triple lifting frame, wherein the lift cylinder is preferably a free-lift cylinder therein.

The invention further relates to an industrial truck having a lifting frame according to either claim 8 or claim 9.

An embodiment of the invention will be explained in greater detail below with reference to the figures.

Figure 3A:
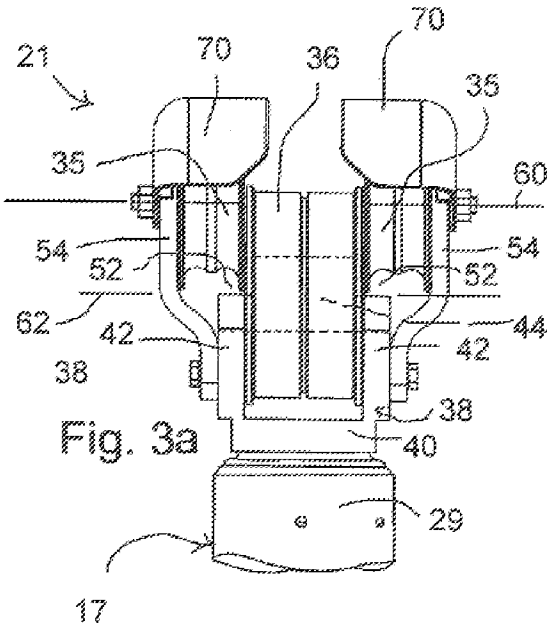
Figure 3B:
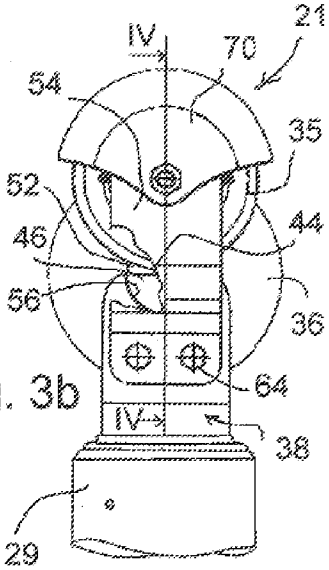

FIGS. 3*a* and 3*b* are a rear view and a side view of the upper end of a lift cylinder according to the invention, having a deflection roller device screwed thereto, an additional-deflection roller support being illustrated in part in a cutaway in FIG. 3*b* in order to make details lying behind it easier to recognise.

Figure 4:
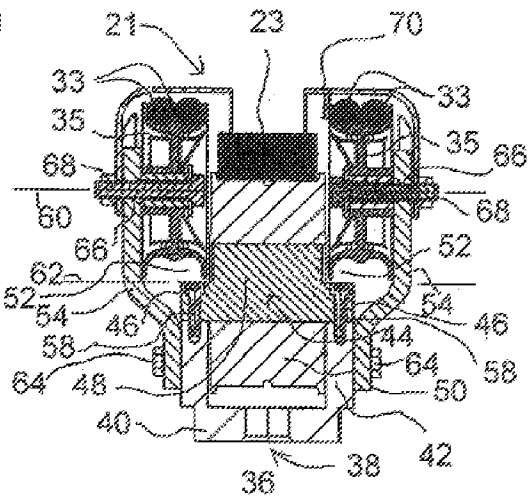

FIG. 4 shows the deflection roller device of FIG. 3*a* and FIG. 3*b* in a longitudinal section, the section plane being indicated by IV-IV in FIG. 3*b*.

Figure 1:
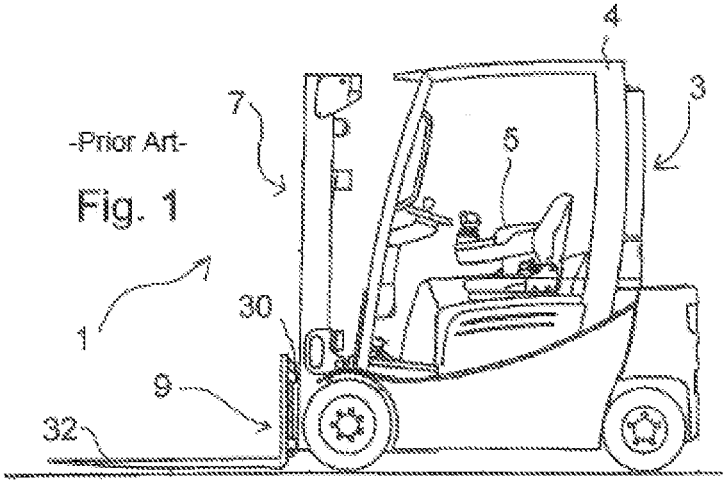
FIG. 1 is a side view of an industrial truck according to the invention.

The embodiment of an industrial truck which is illustrated in FIG. 1 is an electric counterbalance forklift truck 1, which has a vehicle body 3 having a cab 4 and therein a driver seat 5 for an operator. In front of the cab 4 there is a lifting frame 7, on which a load-carrying device 9 is guided so that it can be raised and lowered. The lifting frame 7, which is upright in a vertical orientation in FIG. 1, can be inclined backwards and forwards through a small angular range in order to be able to pick up or deposit loads better.

Figure 2:
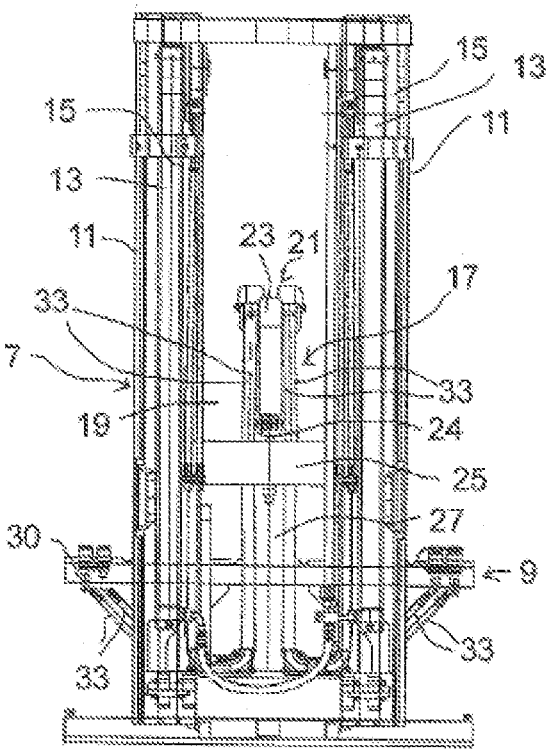
FIG. 2 shows the lifting frame of the industrial truck of FIG. 1, looking at the side facing the driver seat of the industrial truck.

It can be seen from FIG. 2 that the lifting frame 7 is a multiple lifting frame having a fixed (apart from the possibility of inclination) outer pair of masts 11 and telescopable pairs of masts 13, 15 which are displaceably guided thereon or on one another. A free-lift cylinder 17 which is connected to the innermost pair of masts 15 extends upright in a view-through region 19 between the lifting-frame masts 11, 13, 15. An operator sitting in the driver seat 5 of the forklift truck can use this view-through region 19 in order to observe what is happening in front of the forklift truck 1. Since the hydraulic cylinder 17 forms an interfering contour which obstructs in part the view for the operator, said cylinder should be formed to be as slim as possible.

The lift cylinder 17 has at its upper end the deflection roller device 21 which is shown in greater detail in FIGS. 3*a*, 3*b* and 4. The deflection roller device 21 serves to deflect a lifting chain 23 which is fixed at one end at 24 to a crosspiece 25 between the inner frame masts 15 and thus also in relation to the cylinder casing 27 of the lift cylinder 17, and which is fastened by its other end to the load-carrying device 9, so as to be able to draw the load-carrying device 9 upwards if the piston rod 29 of the lift cylinder 17 is extended upwards.

The load-carrying device 9 has a lifting carriage 30 which is displaceable upwards and downwards on the inner pair of lifting-frame masts 15 and which bears a pair of fork arms 32 as load-receiving means. The lift cylinder 17 which is provided here as a free-lift cylinder can move the lifting carriage 30 upwards and downwards on the inner pair of masts 15 in a free lift by means of the lifting chain 23, without the telescoping function of the lifting frame already being used. By means of the lifting chain 23 which is deflected on the deflection roller device 21 from the rear fastening point 24 forwards to the lifting carriage 30, a translation of the stroke of the piston rod 29 of the free-lift cylinder 17 to the load-carrying device 9 is achieved, so that said load-carrying device is moved faster than the piston rod 29 in the event of such a lifting operation. The equivalent applies for the lowering of the load-carrying device 9 by retracting the piston rod 29 of the free-lift cylinder 17 according to the invention.

In the forklift truck 1, hydraulic hoses 33 are guided to the load-carrying device 9, so as to be able to supply hydraulic fluid to components for additional hydraulic functions of the load-carrying device 9. These additional functions may include for example telescoping or lateral displacement of the fork arms 32 on the lifting carriage 30. Since the hydraulic hoses 33 have to follow the lifting and lowering movements of the load-carrying device 9 and in so doing should however not extend in a disordered manner in the lifting-frame region, said hoses are likewise guided over deflection rollers, namely over the additional deflection rollers 35 from the rear region of the lifting frame forwards to the load-carrying device 9. Tightening means (not shown) are provided in order to adapt the length of the hydraulic hoses 33 by slightly tightening the hydraulic hoses 33.

The deflection rollers which can be easily recognised in FIG. 3*a* and FIG. 3*b* due to the omission of the hydraulic hoses 33 and the lifting chain 23, namely the deflection roller 36 for the lifting chain 23 and the additional deflection rollers 35, arranged on either side thereof for the hydraulic hoses 33, are arranged according to the present invention in a spatially optimised manner in the deflection roller device 21 so as to be able to reliably carry out their deflection function, and nevertheless obstruct the view in the view-through region 19 of the lifting frame 7 as little as possible.

The deflection roller device 21 has, as a roller support, a U-shaped yoke 38 having a base 40 and two U-arms 42 which project upwards therefrom. The base 40 is positioned on the upper end of the piston rod 29 of the free-lift cylinder 17 which can be extended upwards, and is rigidly connected to the piston rod 29 there by means of a screw connection. The axle 44 of the chain deflection roller 36 is supported on the U-arms 42, so that the chain roller 36 is received in regions between the two U-arms 42 of the roller support 38.

The roller axle 44 of the lifting chain deflection roller 36 has a central bearing portion 48, the axial length of which is slightly less than the clearance distance between the U-arms 42 of the roller support 38. The roller tyre or roller body 50 proper is positioned radially externally on this cylindrical bearing portion 48, the axial length of which tyre or body substantially corresponds to the axial length of the cylindrical bearing portion 48. In the lower cross-sectional region of the roller axle 44, the fastening portions 46 project axially outwards on either side thereof. Said fastening portions form a respective step having an overlying recess 52. The embodiment of the roller axle 44 which is shown can easily be produced from a cylindrical basic body having the diameter of the cylindrical bearing portion 48, in that on either side axially externally a semi-cylindrical segment is removed by eroding material, so that the remaining semi-cylindrical segments which are axially aligned with each other finally form the fastening ends 46. FIG. 3*b* shows an additional-deflection roller support 54 facing the observer with a cutaway, in order to show that the fastening end 46 located therebehind is received in a seat 56, formed complementarily thereto in semicircular manner, of the relevant U-arm 42 of the roller support 38. Both fastening ends 46 of the roller axle 44 are supported in this manner on top of the U-arms 42 of the roller support 38 and are fixed by means of a screw connection 58. It should be pointed out that the roller axle 44 may also have differently shaped fastening ends if the supporting faces of the roller support 38 are adapted correspondingly. Particular advantages of the invention are obtained if relevant free spaces 52 are left in order to provide space for the additional deflection rollers 35.

In the preferred embodiment of the invention which is shown, the deflection roller device 21 is constructed largely symmetrically, a respective additional deflection roller 35 being arranged on an additional-deflection roller support 54 on either side of the lifting chain deflection roller 36. The additional deflection rollers 35 are rotatably mounted about a common physical axis of rotation 60 which, relative to the physical axis of rotation 62 of the lifting chain deflection roller 36, runs in a manner radially offset but parallel thereto.

The additional-deflection roller supports 54 are elongate offset plate elements, said elements being fixed at their lower ends laterally externally to the U-arms 42 of the roller support 38 by screw connections 64. Each of the additional-deflection roller supports 54 has at its upper end a bearing bore 66, in which an axle pin 68 of an additional deflection roller 35 is axially mounted on one side. The axle pins 68 extend with their free axial ends along the physical axis of rotation 60 to the vicinity of the lifting chain deflection roller 36, so that the additional deflection rollers 35 which are rotatably mounted on the axle pins 68 are also brought to the vicinity of the lifting chain deflection roller 36. The additional deflection rollers 35 are thus located in the gaps between the additional deflection roller supports 54 and the lifting chain deflection roller 36 in a very space-saving manner, also engaging in the recesses 52 in the roller axle 44 of the lifting chain deflection roller 36, as can be easily seen in FIG. 4.

The additional-deflection roller supports 54 have upper protective hoods 70 for the deflection rollers 35, 36, the protective hoods 70 likewise being designed and arranged in a very space-saving manner.

The deflection roller device 21 is recognisably designed to be compact and, on the lift cylinder 17 in the view-through region 19 of the lifting frame 7, only slightly obstructs the view for an operator sitting in the driver seat 5.

The invention claimed is:

1. A deflection roller device (21) for a lift cylinder of an industrial truck (1), the deflection roller device (21) comprising:

a roller support (38);

a lifting chain deflection roller (36) having a roller axle (44) and a roller body (50) rotatably carried on the roller axle (44), wherein the roller axle (44) comprises a cylindrical bearing portion (48) on which the roller body (50) is supported and fastening ends (46) projecting axially outwards on either side of the cylindrical bearing portion and fastened to the roller support (38);

a first additional-deflection roller support (54);

a first additional deflection roller (35) arranged axially adjacent to the lifting chain deflection roller (36) and supported on the first additional-deflection roller support (54) such that the axis of rotation (60) of said additional deflection roller (35) is offset relative to the axis of rotation (62) of the lifting chain deflection roller (36), and the axis of rotation (60) of the first additional deflection roller (35) extends through the roller body (50) of the lifting chain deflection roller (36); and wherein each fastening end (46) of the roller axle (44) of the lifting chain deflection roller (36) forms a respective step defining an overlying recess (52) along a respective side of the cylindrical bearing portion (48) and the first additional deflection roller (35) extends partially into the respective overlying recess (52).

2. The deflection roller device of claim 1, wherein the roller support (38) comprises a U-shaped yoke having a base (40) and two U-arms (42) projecting therefrom, wherein the base (40) is fastened to an extensible end of the lift cylinder (17), whereby the roller axle (44) is fastened to the U-arms (42) with each fastening end (46) of the roller axle (44) received in a seat (56) of a respective U-arm (42).

3. The deflection roller device of claim 2, wherein the first additional-deflection roller support (54) is fastened to the roller support (38) and extends with one end externally along a U-arm (42) of the roller support (38) beyond said roller support (38), wherein an axle (68) of the first additional deflection roller (35) is supported to the one end of the first additional-deflection roller support (54).

4. The deflection roller device of claim 3, wherein the axle (68) of the first additional deflection roller (35) is mounted to the one end of the first additional-deflection roller support (54).

5. The deflection roller device of claim 1, wherein the first additional-deflection roller support (54) bears a protective hood (70) configured to externally cover the additional deflection roller (35).

6. The deflection roller device of claim 1 further comprising a second additional deflection roller (35), wherein the second additional deflection roller (35) is provided on a second additional-deflection roller support (54), whereby the first additional deflection roller (35) and the first additional-deflection roller support (54) are arranged on a first side of the lifting chain deflection roller (36) and the second additional deflection roller (35) and the second additional-deflection roller support (54) are arranged on a second side of the lifting chain deflection roller (36) substantially symmetrical to the arrangement of the first additional deflection roller (35) and the first additional-deflection roller support (54).

7. Lifting frame (7) comprising:

lifting-frame masts (11, 13, 15);

a load-carrying device (9) which is guided on the lifting-frame masts so as to be able to be raised and lowered, a lift cylinder (17) comprising the deflection roller device of claim 1; and a lifting chain (23), which cooperates with the lift cylinder (17), for the load-carrying device (9), the lift cylinder (17) being arranged in a view-through region (19) of the lifting frame (7) between lifting-frame masts (11, 13, 15).

8. Lifting frame according to claim 7, wherein the lifting frame (7) is a telescopic lifting frame and the lift cylinder (17) is a free-lift cylinder therein.

9. Industrial truck (1) comprising the lifting frame (7) according to claim 7.

* * * * *